US008657695B2

(12) United States Patent
Wilson et al.

(10) Patent No.: US 8,657,695 B2
(45) Date of Patent: Feb. 25, 2014

(54) AREAS FOR EQUESTRIAN ACTIVITIES USING STRUCTURAL MODULES

(75) Inventors: Steven Wilson, Reading (GB); Paul David Culleton, Warrington (GB); Carolus Hermanus Van Raam, Hoogmade (NL); Andrew Bryan Shuttleworth, Poulton-le-Fylde (GB); David Graham Andrews, Kirkham (GB)

(73) Assignee: Equaflow Ltd., Lancashire (GB)

( * ) Notice: Subject to any disclaimer, the term of this patent is extended or adjusted under 35 U.S.C. 154(b) by 253 days.

(21) Appl. No.: 13/202,748

(22) PCT Filed: Feb. 23, 2010

(86) PCT No.: PCT/GB2010/000329

§ 371 (c)(1), (2), (4) Date: Nov. 1, 2011

(87) PCT Pub. No.: WO2010/097579

PCT Pub. Date: Sep. 2, 2010

(65) Prior Publication Data

US 2012/0040767 A1 Feb. 16, 2012

(30) Foreign Application Priority Data

Feb. 24, 2009 (GB) ..... 0903130.3

(51) Int. Cl.
*A63K 1/02* (2006.01)
*A63K 1/00* (2006.01)

(52) U.S. Cl.
USPC ..... 472/86; 472/92

(58) Field of Classification Search
USPC ..... 472/85–90, 92–94, 136
See application file for complete search history.

(56) References Cited

U.S. PATENT DOCUMENTS

| | | | | |
|---|---|---|---|---|
| 4,498,666 | A * | 2/1985 | McCallum | 472/86 |
| 7,090,586 | B1 * | 8/2006 | Everett et al. | 472/92 |
| 7,571,573 | B2 * | 8/2009 | Moller, Jr. | 52/177 |

FOREIGN PATENT DOCUMENTS

| | | |
|---|---|---|
| DE | 10229289 | 1/2004 |
| DE | 102005023413 | 11/2006 |

(Continued)

OTHER PUBLICATIONS

International Search Report for PCT App. No. PCT/GB2010/000329, mailed Jun. 29, 2010.

*Primary Examiner* — Kien Nguyen
(74) *Attorney, Agent, or Firm* — McDonnell Boehnen Hulbert & Berghoff LLP

(57) ABSTRACT

The present invention relates to an area suitable for equestrian use. The area comprises an upper, equestrian surface layer, and a sub-surface support layer which includes a plurality of laterally arranged load bearing structural modules. Each module comprises a top wall and a bottom wall spaced therefrom by one or more supporting elements so as to define an interior volume between the top and bottom walls, and is provided with at least one aperture to permit the flow of water into and out of the volume. There is a system for retaining water within at least some modules in the sub-surface support layer. A water permeable layer that is impermeable to solid particles of the upper, equestrian surface layer is provided between the structural modules and the equestrian surface layer. A wicking system is in fluid communication with the interior volumes of at least some of the modules and have portions extending upwardly to transfer water to the upper, equestrian surface layer from the sub-surface support layer.

25 Claims, 8 Drawing Sheets

(56) References Cited

FOREIGN PATENT DOCUMENTS

| | | |
|---|---|---|
| DE | 202008006572 | 8/2008 |
| JP | 07-042109 | 2/1995 |
| JP | 08-000110 | 1/1996 |
| WO | 02/14608 | 2/2002 |
| WO | 03/033818 | 4/2003 |
| WO | 2009/030896 | 3/2009 |

* cited by examiner

AREAS FOR EQUESTRIAN ACTIVITIES USING STRUCTURAL MODULES

CROSS REFERENCE TO RELATED APPLICATIONS

The present application is a U.S. National Phase Application pursuant to 35 U.S.C. §371 of International Application No. PCT/GB2010/000329 filed Feb. 23, 2010, which claims priority to GB Patent Application No. 0903130.3 filed on Feb. 24, 2009. The entire disclosure contents of these applications are herewith incorporated by reference into the present application.

BACKGROUND

This invention relates to the structure of areas for equestrian activities in which horses can, for example, be exercised, trained or take part in competitive activities. In particular the invention relates to arrangements in which an upper equestrian surface is supported by a sub-surface layer.

It can be important to regulate the water content of an equestrian surface. It is important to ensure that the surface is not too dry or too wet. A dry surface may be too hard and a wet surface may be too soft and/or slippery. In addition, dry surfaces can become cracked, uneven or ridged. A surface that does not have a suitable water content, being either too wet or too dry, can cause injury to both horses and riders and/or hinder performance.

It is known to provide a layer of sand beneath an upper equestrian surface and to provide the sand with a drainage pipe to drain off excess water from the sand. In addition, one or more pipes can be located within the sand to provide a supply of water from a storage tank to top up the water content of the sand when it becomes too dry. Moisture sensors or water level sensors detect when the water level is too low and a pump pumps the water from the storage tank or from a water main or other water source to the pipes in the sand. However, such a system is not self-regulating (sensors and pumps are needed) and requires some form of power to drive a pump to transport water from the storage tank.

Another important aspect of equestrian surfaces is the consistency of the structural performance of the surfacing layers to provide consistency in the usage of the surfacing such that the performance of a horse is neither artificially enhanced nor impeded. Consistent structural behaviour also avoids injury to horses travelling on the surface; inconsistent structural performance can lead to lameness in horses. A key element in achieving consistent structural performance is the sub-surface layer upon which the equestrian surfaces are laid. For the sub-surface layer it is known to use combinations of granular materials mixed to provide the desired structural performance, e.g. compaction. However, such granular materials are variable in property and the structural behaviour of one mix can vary widely from another and this can lead to inconsistencies in the performance of the overlying equestrian surfaces.

The present invention is concerned with a number of new structures which allow for more effective regulation of the water content of an equestrian surface and consistency in the performance of the surface.

JP 08-000110 A discloses a system of pallets for supporting and transporting real lawn inside a multipurpose dome. The pallets each comprise an upper holding portion which holds or supports the lawn on a support plate. Beneath this holding portion is a hollow part which contains air, and sponge for holding water. The sponge is connected to the earth and sand of the lawn via a so-called pump part. The pump part is formed from so-called pumping material which is made of cloth and passes through a hole in the support plate of the holding portion. The pump part transports water from the sponge to the earth and sand of the lawn by capillary action. Similar pump parts are also provided to transport water by capillary action between adjacent pallets.

However, a disadvantage with the system of JP 08-000110 A is that no means are provided to allow water to pass down from the lawn into the hollow part. Furthermore, water cannot drain out of the hollow part. In JP 08-000110 A, water can only pass up from the hollow part to the lawn. This may not be a problem in a multipurpose dome, where there would not be any rainfall. However, it does mean that the system of JP 08-000110 A is unsuitable for use outside where precipitation would inevitably fall at some point on the system and could cause water logging.

The pallets of JP 08-000110 A require a firm supporting base (e.g. a sub-base layer or concrete slab) on which to place them. They could not, for example, be located directly on earth since the pallets could then move relative to one another (due to differential settlements in the earth beneath), leading to an uneven surface.

In the field of construction generally, it is known from WO 02/14608 to form a sub-surface layer from a structural module instead of traditional particulate materials such as natural aggregate or sand. The preferred module is cuboid in form, and may, for example, be moulded from strong plastics. In a preferred arrangement each module is formed from a top half which includes a top wall and the upper part of a peripheral sidewall, and a bottom half defining a bottom wall and the lower part of the peripheral sidewall. The top and bottom halves may each be provided with a set of half-pillars extending towards one another, the two sets of half-pillars co-operating with one another to form pillars extending between the top and bottom walls to resist vertical and lateral crushing of the module. The top and bottom halves may be two integral plastics moulded components which are fitted one inverted on top of the other. Preferably, the module further comprises a network of bracing members extending between the pillars within the module to resist deformation of the module in a horizontal plane. In the preferred arrangement the walls and network have apertures formed therein to allow water to flow both vertically downwards and horizontally through the module, for drainage purposes.

In WO 2009/030896 filed on 3 Sep. 2008, published on 12 Mar. 2009, which was not published as of the priority date of the present application and in respect of which there are inventors in common with those of the present application, there is disclosed a structural module comprising a load bearing base unit and porous material, wherein the base unit has a top wall and a bottom wall spaced therefrom by one or more supporting elements so as to define a volume between the top and bottom walls, the base unit being provided with apertures to permit the flow of liquid into and out of the volume, and wherein the porous material is a foamed polymeric material which occupies a substantial portion of the volume within the base unit and absorbs and retains substantial quantities of water that pass into the enclosed volume through the apertures. In preferred embodiments the modules are as described in WO 02/14608, but with the addition of foam blocks within the modules.

SUMMARY

One aspect of the present invention relates to the provision of such modules in a sub-surface support layer for an equestrian surface. Thus, viewed from one aspect the invention provides an area suitable for equestrian use, comprising an upper, equestrian surface layer, and a sub-surface support layer which includes a load bearing structural module, which comprises a top wall and a bottom wall spaced therefrom by one or more supporting elements so as to define a volume between the top and bottom walls, the module being provided with at least one open aperture to permit the flow of liquid into and out of the volume, wherein the structural module contains a foamed polymeric material which occupies a substantial portion of the volume within the structural module and can absorb and retain substantial quantities of water that pass into the enclosed volume through the at least one aperture, wherein a water permeable layer that is impermeable to solid particles of the upper, equestrian surface layer is provided between the structural module and the upper, equestrian surface layer, and wherein a portion of a wicking means is in fluid communication with the interior of the module and extends upwardly to transfer water to the upper equestrian layer from the sub-surface support layer.

It is also possible to provide a structure suitable for use in an equestrian context, using the structural modules without foamed polymeric material being contained therein, or only being provided within some of them. Therefore, viewed from another aspect of the invention, there is provided an area suitable for equestrian use, comprising an upper, equestrian surface layer, and a sub-surface support layer which includes a plurality of laterally arranged load bearing structural modules, each of which comprises a top wall and a bottom wall spaced therefrom by one or more supporting elements so as to define an interior volume between the top and bottom walls, and is provided with at least one open aperture to permit the flow of water into and out of the volume, and there being means for retaining water within at least some modules in the sub-surface support layer, wherein a water permeable layer that is impermeable to solid particles of the upper, equestrian surface layer is provided between the structural modules and the equestrian surface layer, and wherein wicking means are in fluid communication with the interior volumes of at least some of the modules and have portions extending upwardly to transfer water to the upper equestrian surface layer from the sub-surface support layer.

The means for retaining water in the module could be, for example, a waterproof layer provided beneath the module, a tray provided in the base of the module, foamed polymeric material or other water absorbent material contained within the module, or any other suitable means for retaining water in the module. Such other water absorbent material could be in the form of blocks or granules, for example. A combination of water retaining means may be provided, such as foamed polymeric or other water retaining material within the module, and a waterproof membrane beneath the module.

In general there will be a subsurface layer comprising a number of the structural modules arranged horizontally, and if desired vertically—i.e. with stacked modules. All or substantially all of the modules in the layer may be provided with foamed polymeric material or other water absorbent material. Alternatively there may be a mix of modules, some containing the water absorbent material and some not. Mixing the modules in this way enables a structure to be assembled in which there are regions where water is contained in absorbent material, and other areas where the modules are empty so that fast water distribution routes can be provided, defined by the modules.

The present invention also relates to a method of distributing water in an equestrian area.

Thus, viewed from another aspect the invention relates to a method of distributing water in an equestrian area comprising: providing an upper, equestrian surface layer; providing a load bearing structural module beneath the upper, equestrian surface layer, the structural module having a top wall and a bottom wall spaced therefrom by one or more supporting elements so as to define a volume between the top and bottom walls, the structural module being provided with at least one open aperture; providing means for retaining water in the module; providing a water permeable layer that is impermeable to solid particles of the upper, equestrian surface layer between the structural module and the upper, equestrian surface layer; and transporting water from the structural module towards an upper, equestrian surface layer with wicking means.

In the above aspects of the invention, rain that falls on the equestrian surface can pass through the upper, equestrian surface layer and the water permeable layer to the module where it can be retained by the water retaining means, or in the foamed polymeric material in the module. The wicking means can then transport water from the module back up to the equestrian surface layer by wicking it from the structural module to the water permeable layer. The water can then spread through the water permeable layer and pass into the upper equestrian layer.

In this way, water can be drained from the upper, equestrian surface layer and stored in the module to prevent the upper, equestrian surface layer from becoming waterlogged. Providing wicking means is a simple and convenient way to automatically transport water from the module to the upper, equestrian surface layer, as required, without need for a pump. This means that no power and little or no maintenance is required. Nevertheless, in some arrangements pumping systems may be provided, for use if for example there is need to call on an external store of water in a dry spell.

The water permeable layer can allow water to pass from the upper, equestrian surface layer to the module. It also prevents solid particles from the upper, equestrian layer from descending into the module. It may also provide some degree of cushioning for horses using the area. It could be made of geotextile fleece material and/or it could comprise hydrophilic fibres. The protective layer could be made of the same material as the wicking means, or it could be made of a different material.

The size of the module (its water storage capacity), the size, location and geometry of the water retaining means and/or the amount of foamed polymeric material or other water absorbent material contained in the module, and the amount of wicking means required for optimum performance of the area can be determined by considering factors such as the average rainfall, temperature, wind speed, and humidity of the location where the surface is to be used, as well as the ideal moisture content of the upper, equestrian surface layer for its intended purpose.

The invention is particularly, but by no means exclusively, concerned with such arrangements and methods in which the upper, equestrian surface is of an artificial type rather than natural such as soil and grass.

A typical all-weather equestrian surface may be formed from, for example, granules or fibres which comprise polymer material, a filler such as sand, and a binder. Such a surface will be supported by one or more sub-surface layers, which typically might include soil, sand and so forth, with a bottom or foundation layer of aggregate if desired.

In any or all of the aspects of the invention described above, the further features described below may be provided.

Preferably, at least one aperture is provided in the bottom wall. Preferably, this aperture is arranged to allow water to pass at least downwards therethrough.

Preferably, at least one open aperture is provided in one or more of the at least one supporting elements, to allow water to pass substantially laterally therethrough. For example, water may be allowed to pass into an adjacent module.

Preferably, the area comprises a waterproof layer provided beneath a layer of the structural modules, to prevent water retained in or passing through the structural modules from leaking into the ground below. Ideally, the waterproof layer is flexible, so that it can be installed easily, and strong enough that it is not easily torn or damaged during installation or use. The waterproof layer may also extend around the sides of the structural modules to ensure that water cannot escape laterally, and in particular may extend up the sides of modules at the edge of the layer.

It is preferred that the wicking means is located, at least partially, beneath the structural module and adjacent to a side of the structural module. This allows the wicking means to transport water from the bottom of the structural module, where it may tend to accumulate, to the water permeable surface above. Water absorbent material in a module may itself provide a wicking effect. The wicking means may be arranged to substantially encapsulate the structural module or structural modules. The wicking means could comprise hydrophilic fibres, for example, which can transport water upwards by capillary action.

Preferably the components of the area are non bio-degradable (unless a natural upper, equestrian surface layer is used, in which case this layer may be, at least partially, biodegradable).

Some or all of the structural modules may be connected to other structural modules, for example by interlocking means provided on the sides of the structural modules, such as the means described in WO 02/14608. The interlocking means may allow formation of a rigid or semi-rigid array of two or more structural modules which cannot excessively or unacceptably move horizontally or vertically relative to one another. This means that the modules may be placed directly on the earth or prepared foundation (or indirectly but with only a non-supporting layer such as wicking means and/or a sealing layer between the modules and the earth or foundation) without a further supporting sub-base layer being required, because the modules will not be liable to excessive or unacceptable relative movement due to differential settlement in the earth and/or foundation and the surface of the structural modules should remain sufficiently flat and even.

Alternatively, the structural modules may be spaced from one another. This alternative may be useful if cost is a factor or if the surface requires less regulation of its moisture level (e.g. in an area where the frequency and volume of rainfall is relatively close to ideal).

The structural module or units may have a high storage to volume ratio (e.g. 80%) and should be strong enough to support the surface above. The structural modules could be made of a suitable plastic, for example.

In a preferred embodiment, the structural module has a peripheral wall extending between the top and bottom walls, and acting as a supporting element. One or more of the top, bottom and peripheral walls may be provided with the apertures to permit liquid flow to and from the volume. The structural module may be of generally cuboid form, and the top and bottom walls may be generally parallel.

One or more of the structural module or units may contain a porous block for holding water. The porous block provides an effective means to hold the water in the structural modules and release the water therefrom at a predetermined rate. Preferably, the porous block is a porous foamed polymeric material. The porous foamed polymeric material can absorb and retain substantial quantities of water that passes into the enclosed volume through the apertures.

Preferably, the porous foamed polymeric material has a cellular structure. It may, for example, be an open-celled phenolic foam. One suitable type of foam is made from a phenol formaldehyde resin which has been reacted with an acid catalyst to be cured, and to which a hydrocarbon has been added to make the resin expand.

The foamed polymeric material could be in particulate form, for example being in the form of spheres or the like. If the apertures in the structural module are small enough to retain the particulate material, it may be added loose to the interior of the structural module. If that is not so, and in any event for more secure retention of the material, the particulate foamed polymeric material could be contained within a porous or permeable bag, such as a net, and placed in the structural module. Preferably, however, the foamed polymeric material is in the form of one or more blocks or slabs. In such an arrangement, a block can have any shape and does not need to be cuboid for example. Large spheres, irregular shapes and so forth may all be used.

The liquid retentive polymeric foam material for use in accordance with various aspects of the invention is porous so that it can absorb water and/or other liquids. The material should ideally also be such that it undergoes little or no expansion when it absorbs water or other liquids. The material should preferably be non-biodegradable.

The liquid retentive foam material could be relatively solid, or alternatively it could be compressible such as a sponge-like foam.

The liquid retentive foam material may have a cellular structure with an average pore size (i.e. cross sectional area) in the range of for example about 1200 to about 10000 $\mu m^2$, preferably about 1500 to about 4000 or about 4500 $\mu m^2$, and typically an average pore size of around 4000 to 4225 $\mu m^2$.

Preferably, the liquid retentive material is an open celled phenolic foam, for example made from phenol formaldehyde resin, such as that marketed by Smithers-Oasis under the trade mark OASIS™ which is used principally as floral foam into which flower stems can be pushed. This type of foam has been classified for disposal in landfill sites in the UK. It is inert, does not biodegrade over time, does not expand and has minimal mechanical strength, so that it crumbles under load. The OASIS™ foam is made from phenol formaldehyde resins which are reacted with an acid catalyst to be cured, and hydrocarbons are added to make the resin expand. The final product, typically in the form of a brick, has no hydrocarbons present, and has slight acidity with everything else inert. The potential for water retention and other qualities is a function of the material's pore size. The pore size is related to the density of the foam produced at the manufacturing stage. For example, the current range of OASIS™ products available for general flower arranging purposes includes these three densities:—

1. Premium Foam: about 21 to about 23 kg/m3 density gives the best water retention due to it greater volume of cells within the structure.
2. Ideal Foam: about 19 kg/m3 to about 21 kg/m3 and good water retention.
3. Classic Foam: just below 19 kg/m3 and good water retention.

A typical foam material for use in accordance with the invention can preferably hold between about 40 to 50 times its own mass in water, for example one gram of the foam can retain between about 40 and about 50 ml of water and in a preferred embodiment of the invention about fifty times its own mass. These figures are for the material before use in situ. In a preferred embodiment, in situ the material holds between about 20 to 50 times its own mass of water, more preferably between about 40 and 50 times, and typically between about fifteen and about twenty times its own mass of water.

Alternative foams, or indeed other materials, may be used to absorb and retain water, such as polyurethane and polyisocyanurate foams, urea-formaldehyde (carbamide-formaldehyde) or epoxy (sprayed or foamed in situ). Although the polyurethane foams do not have particularly good water retention properties they can be modified so as to increase the water retaining capabilities. Thus, polyurethane derivatives may be suitable for use in systems in accordance with the invention. It may also be possible to improve the water retention properties of polyurethane foams by having a closed cell structure. Indeed, in general, foams used in systems according to the invention can be open or closed cellular structured within the foams, but primarily the optimum used would be open celled. Modifications to foams so that they can perform the same or similar functions of the preferred foams, are within the scope of the invention.

There is also on the market a cross-linked polyacrylamide, which is a crystal-like structure that absorbs 500 times its own mass in water. It is possible that this could be used in a system in accordance with the invention although it suffers from expansion and bio-degradability problems over time. Also on the market there is another compound that has good water absorbing properties called sodium polyacrylate. It is not foam, and more like a desiccant, but might be usable in aspects of the invention, alone or in combination with a foamed polymeric material.

In the case of foamed polymeric material, it may be preformed in suitable blocks, slabs or the like, or it could be formed in situ.

Whilst the foamed material may be placed within the structural module with freedom to move, preferably an element such as a block or slab is fixed spatially within the structural module by suitable locating means. For example, the structural module may incorporate internal pillars and the block or slab may have apertures formed therein so that the pillars can pass through the apertures, the aperture size being such that there will be sufficient friction between the pillar and the block or slab to hold the block or slab in position both horizontally and vertically. The internal pillars serve as supporting elements extending between the top and bottom walls.

There are many possibilities for the proportion of the free interior volume that should be occupied by the foamed polymeric material, depending upon the application in which the structural module will be used. The occupied portion could be substantially all of the free interior volume, a major part of the interior volume and a minor part of the interior volume. Possibilities range for example from about 20% to substantially all of the free interior volume, and encompass about 25%, about 30%, about 35%, about 40%, about 45%, about 50%, about 55%, about 60%, about 65%, about 70%, about 75%, about 80%, about 85%, about 90%, and about 95%, about 100%, or be within any range whose lower limit is defined by one of those values and whose upper limit is defined by another of those values. The free interior volume means the interior volume within the walls, excluding space taken up by elements such as pillars or other structural members within the interior volume.

Preferably, the portion of the interior volume of the structural module that is occupied by the foamed polymeric material occupies a single layer extending horizontally. This layer could extend from adjacent the top wall, or from adjacent the bottom wall, or could be arranged intermediate the two, for example about mid-way between the two. In some preferred arrangements, a substantial portion of the interior volume is left vacant, for example around 50%, providing a horizontally extending space across the structural module.

In general, a block or slab of the porous polymeric material may have a height which does not exceed substantially the maximum height to which water can be retained within the slab or block. In the case of the preferred phenol formaldehyde resin, this distance might be about 75 mm or about 150 mm, and in general maximum heights might be about 75 mm, about 100 mm, about 125 mm, about 150 mm, about 175 mm, or about 200 mm, or be within any range whose lower limit is defined by one of those values and whose upper limit is defined by another of those values.

In general, a structural module may be have a depth of about 75 mm, about 100 mm, about 125 mm, about 150 mm, about 175 mm, about 200 mm, about 225 mm, about 250 mm, about 275 mm, about 300 mm, about 325 mm, about 350 mm, or be within any range whose lower limit is defined by one of those values and whose upper limit is defined by another of those values. Preferably the length and breadth dimensions of the structural module are both greater than the depth. A typical structural module in a preferred embodiment might have a length of between about 700 mm to about 720 mm, for example being about 710 mm; a breadth of from about 350 mm to about 360 mm, for example being about 355 mm; and a depth in the ranges set out above, for example being about 150 mm, about 250 mm or about 300 mm.

As regards the structure of the structural modules, preferably these are formed of moulded plastics material. In a preferred arrangement, each structural module is formed from a top half which includes a top wall and the upper part of a peripheral sidewall, and a bottom half defining a bottom wall and the lower part of the peripheral sidewall. The top and bottom halves may be fitted one inverted on top of the other. A slab, block or the like of the foamed polymeric material can be located within one or both halves before they are fitted together. The top and bottom halves may each be provided with a set of half-pillars extending towards one another, the two sets of half-pillars co-operating with one another to form pillars extending between the top and bottom walls to resist vertical crushing of the structural module. In this case, the foamed material may have apertures and be placed over a set of pillars before the halves are joined together. The halves may be two similar integral plastics moulded components.

Preferably, the structural module further comprises a network of bracing members extending between the pillars within the structural module to resist deformation of the structural module in a horizontal plane. In the preferred arrangement the walls and network have one or more apertures formed therein to allow fluid flow both vertically and horizontally through the structural module.

It will be appreciated that the presence of a peripheral wall can be used to separate and support the top and bottom walls.

Although in the preferred embodiment the structural module is formed of plastics and load bearing, it could be made of any other type of material that could support the loads expected in a particular environment, such as concrete, metal, wood, composite materials and so forth. In some environments the structural modules need not be load bearing.

In the preferred arrangements a protective layer is located above the layer of structural modules. This could be positioned above or below the water permeable layer. The protective layer can provide a cushioning effect for any persons or animals using the area, as well as helping to ensure that any particulate matter which forms or is contained in the upper surface cannot descend into the structural module below. It is preferred that the protective layer is water permeable to allow water to pass from the upper surface into the structural modules, and then to pass out again to maintain an appropriate moisture content for the upper layer. Alternatively it could be formed of a water-permeable material, such as rubber or plastics, with holes formed therein to allow water to pass through the layer in both directions. The protective layer could be a geotextile fleece layer and/or it could comprise hydrophilic fibres. The protective layer could be made of the same material as the wicking means, or it could be made of a different material.

The area may comprise one or more water storage tanks connected to the structural modules. A tank can provide extra water storage capacity for times when the capacity of the structural module or units is met, e.g. where there is heavy rainfall and/or during a storm. They can also provide a source of water which may be used to top up the water content of the upper surface when it becomes too dry and/or if the water stored in the structural modules runs out.

Alternatively, or in addition, the structural modules may be connected to a separate water supply, such as, a mains water supply, which can be used to top up the water stored in the structural module or units.

The area may also comprise heating means for heating the area. Preferably, such an area would also comprise a temperature sensor for measuring the temperature of the area. The temperature sensor could, for example, measure the temperature inside a structural module. Additional temperature sensors could be provided to ensure good coverage over the area. The heating means, together with a control system connected to the temperature sensor or sensors could prevent the temperature of the area, especially the temperature of the water in the area, from falling below a certain temperature such as 5° C., 4° C., 3° C., 2° C., 1° C. or 0° C., for example. Such a system would help to prevent the water in the area from freezing, and/or from frost developing on the upper surface layer.

The heating means could, for example, comprise means, such as a pipe, for circulating warm water and/or air through the area, in particular through or around the structural modules.

The upper surface layer may be formed of real or artificial soil, sand and/or grass, or a mixture thereof. It may contain additives such as geotextile fibres or fragments. The upper surface layer may have a wax coating to enhance its drainage and water-retention properties.

The area could be used in an outdoor or an indoor environment. If used indoors the area should be connected to a suitable water supply. The area could be portable so that it could be moved and installed at temporary equestrian events.

Although the present invention has been described in relation to equestrian areas, it will be appreciated that whilst in accordance of the above aspects of the invention the upper surface should be suitable for equestrian use, it may be used for other purposes also. Embodiments of the structures may also be adapted for use such that the upper surface is not suitable for equestrian use. Thus, other aspects of the invention envisage use of the structures in other environments, whether or not they are suitable for equestrian use. The structures can be used for many other areas such as sports fields, pitches and tracks, and various types of arena, both indoors and outdoors.

Thus, for example, viewed from another aspect the invention provides an area comprising an upper surface layer which includes particulate material, and a sub-surface support layer which includes a number of load bearing structural modules, each structural module comprising a top wall and a bottom wall spaced therefrom by one or more supporting elements so as to define a volume between the top and bottom walls, the module being provided with at least one open aperture to permit the flow of liquid into and out of the volume, there being a water permeable layer that is impermeable to solid particles of the upper surface layer provided between the structural module and the upper surface layer, there being a water impermeable layer beneath the support layer of structural modules, and there being wicking means in fluid communication with the interior of at least some of the modules and extending upwardly to transfer water to the upper surface layer from the sub-surface support layer; and wherein at least some of the structural modules contain water absorbent material for retaining substantial amounts of water within the module.

An area comprising heating means and a temperature sensor is considered to be novel in its own right and is applicable to other systems, including those not intended for equestrian use and not involving absorbent material in the modules.

Thus, viewed from a further aspect the invention relates to an area comprising an upper surface layer which includes particulate material, and a sub-surface support layer which includes a number of load bearing structural modules, each structural module comprising a top wall and a bottom wall spaced therefrom by one or more supporting elements so as to define a volume between the top and bottom walls, the module being provided with at least one aperture to permit the flow of liquid into and out of the volume, and means for retaining water within the volume, there being wicking means in fluid communication with the interior of at least some of the modules and extending upwardly to transfer water to the upper surface layer from the sub-surface support layer; the area further comprising heating means for heating the area and a temperature sensor for measuring a temperature of the area. The temperature sensor could, for example, measure the temperature inside a structural module. Additional temperature sensors could be provided to ensure good coverage over the area. The heating means, together with a control system connected to the temperature sensor or sensors could prevent the temperature of the area, especially the temperature of the water in the area, from falling below a certain temperature such as 5° C., 4° C., 3° C., 2° C., 1° C. or 0° C., for example. Such a system would help to prevent the water in the area from freezing, and/or from frost developing on the upper surface layer.

The heating means could, for example, comprise means, such as a pipe, for circulating warm water and/or air through the area, in particular through or around the structural modules.

Some embodiments of the invention will now be described by way of example only and with reference to the accompanying drawings in which:

DETAILED DESCRIPTION

Referring now to FIGS. 1 to 5, a structural module is shown at 10 comprising a top wall 11, a bottom wall 12 and a peripheral wall 13 extending between the upper wall 11 and the bottom wall 12 to provide at least one side wall and in this example four side walls. The top wall 11, bottom wall 12 and peripheral wall 13 define a volume 14.

Figure 2:
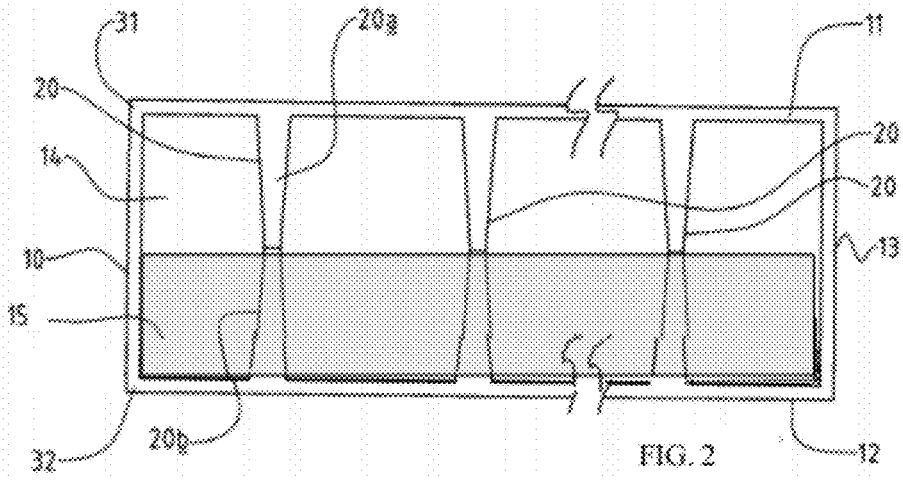
FIG. 2 is a section of FIG. 1.

In FIG. 2, located within the volume 14 is a porous rectangular block 15. The porous material in this case is a foamed phenol formaldehyde resin, such as that marketed by Smithers-Oasis under the trade mark OASIS™ as discussed earlier. The block 15 is fixed relative to the top wall 11, bottom wall 12 and peripheral wall 13 and in this case occupies the bottom part of the volume 14, extending upwards for approximately half of the height of the volume.

Figure 3:
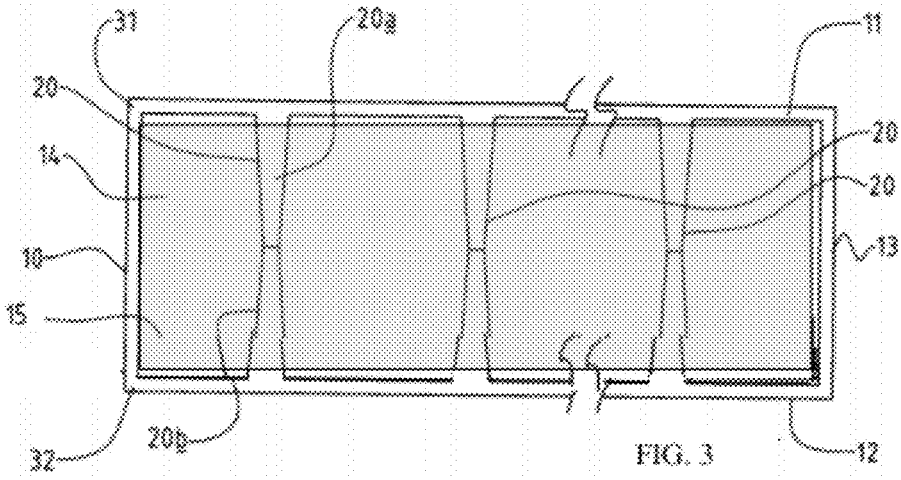
FIG. 3 is a section of FIG. 1, showing an alternative porous element.
Figure 4:
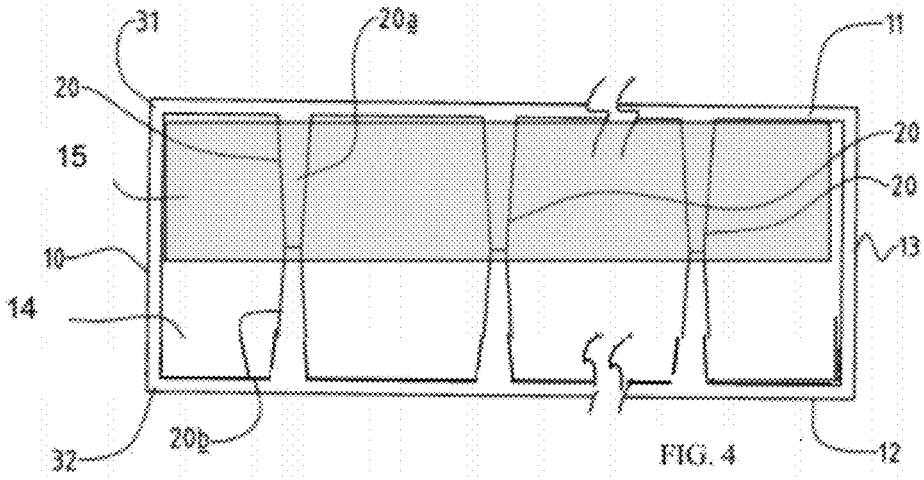
FIG. 4 is a section of FIG. 1, showing a further alternative porous element.

In FIG. 3 there is shown an alternative arrangement in which the block 15 occupies substantially all of the volume 14, and in FIG. 4 there is shown an alternative arrangement in which the block 15 occupies the top half of the volume 14.

Figure 1:
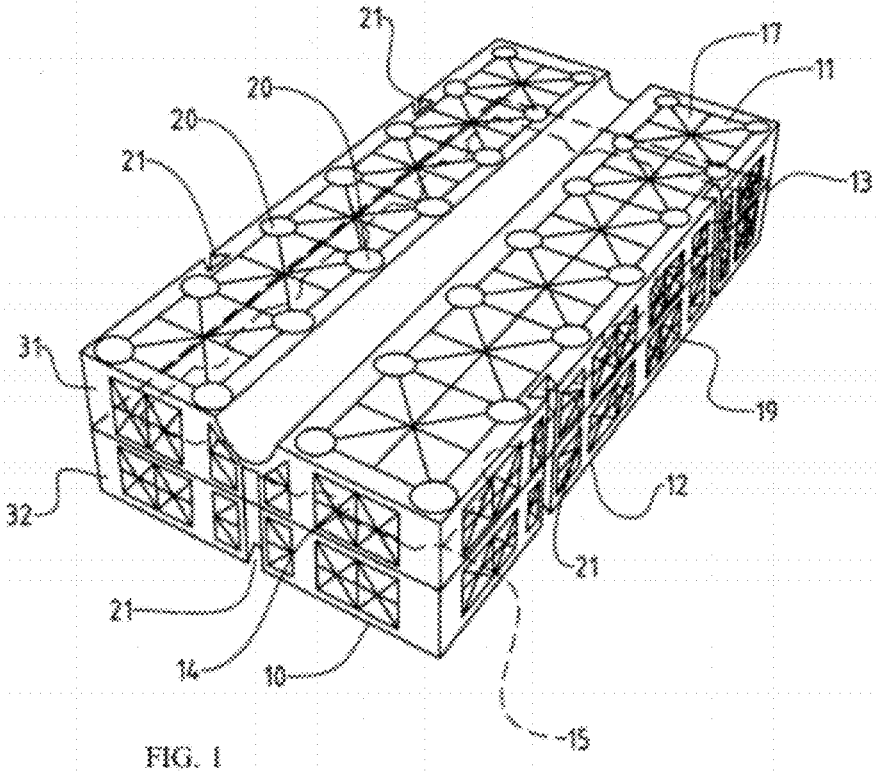
FIG. 1 is a perspective view of a structural module with a porous element for use in the present invention.
Figure 6:
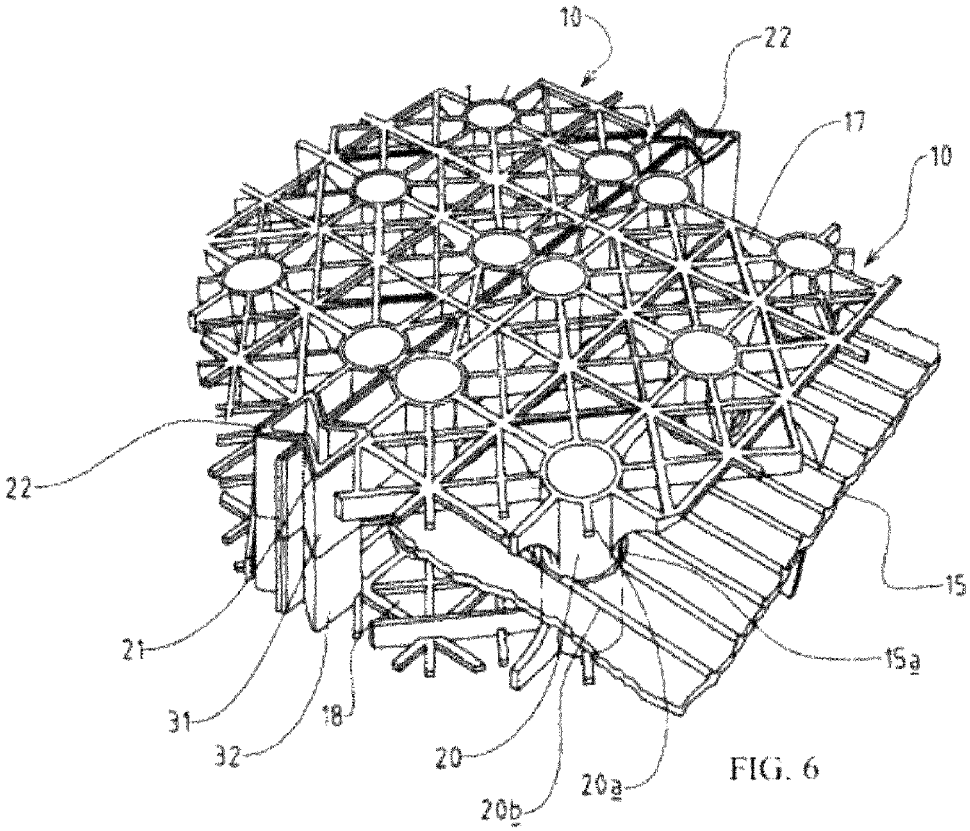
FIG. 6 is a broken away perspective view on a larger scale of part of two of the structural modules of FIG. 1 connected to one another.

As seen in FIGS. 1 and 6, the top wall 11, bottom wall 12 and peripheral wall 13 comprise a plurality of apertures 17, 18, 19 which, in this example, are generally triangular and are defined by a plurality of pillars forming the respective walls. The apertures 17, 18, 19 are open and thus permit fluid to move both in and out of the structural module 10.

Internally, in this example, the structural module 10 comprises a plurality of pillars 20 extending between the top wall 11 and the bottom wall 12. In the present example, the pillars are generally cylindrical and hollow and are distributed in a grid arrangement across the length and width of the structural module 10. The pillars 20 are sufficiently strong to resist crushing of the structural module 10 and thus enable the structural module 10 to support a desired vertical or lateral load depending on the environment in which the structural module 10 will be used.

To allow a plurality of structural modules 10 to be rigidly connected together, the structural module 10 is provided with a plurality of keyways 21 located in the ends of the sides thereof. In this example, each keyway 21 is a groove of a generally female dovetail shape in plan view for slidably receiving a tie member 22. As seen in FIG. 6, the tie members 22 are of "bow tie" cross section, comprising a pair of trapezoids joined together along their short parallel sides to be received in the keyways 21 of adjacent structural modules 10 to hold them together. As will be apparent, the generally rectangular shape of the structural modules 10 enables a plurality of structural modules 10 to be connected together to form an extensive, substantially continuous layer of structural modules 10 of any desired area.

Advantageously, each structural module 10 may be formed in two parts which are connected together to form the structural module 10, where a porous block 15 can be introduced into the structural module prior to connecting the two parts together, if a porous block is required. Alternatively, the two parts can be connected together to form the structural module 10 without any porous block 15 being contained therein.

With reference to FIGS. 1 and 6, advantageously the structural module 10 may comprise a top part 31 which defines the top wall and part of the peripheral side wall and a bottom part 32 defining the bottom wall and the lower part of the peripheral side wall. The top part 31 and the bottom part 32 are each provided with a set of half-pillars 20*a*, 20*b* whereby the two sets of half-pillars, 20*a*, 20*b* engage one another to form the pillars 20 extending between the top wall 11 and the bottom wall 12. Preferably, the top part 31 and the bottom part 32 comprise similar plastic moulded components. The structural module 10 may be formed by inverting one component and placing it on top of the other, and, if required, introducing the porous block 15 into the volume prior to joining the two parts.

In some cases one or more structural modules which are not filled with foam can be used. Where foam is used, it need not be introduced as discussed above, but could be in the form of one or more blocks not shaped to the interior of the structural module, as loose material, or be injected as foam and cured in situ.

Figure 5:
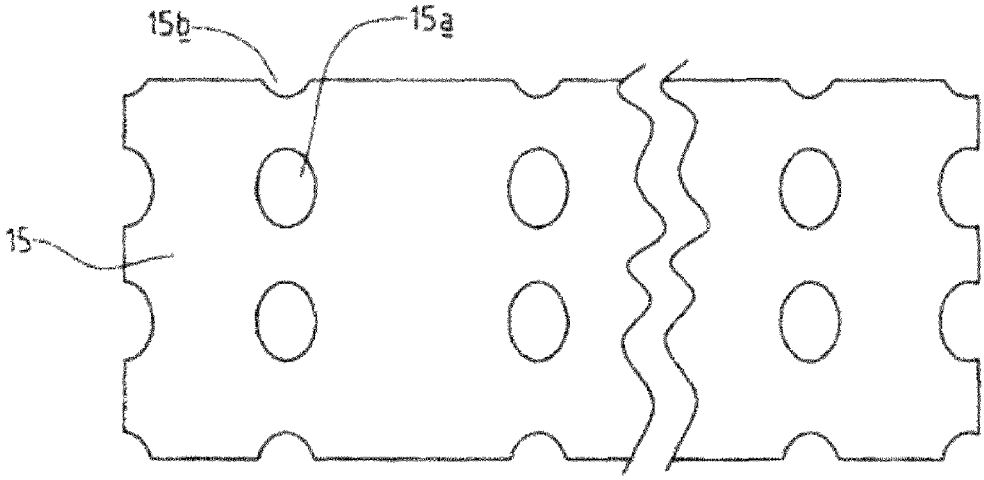
FIG. 5 is a plan view of the porous element of FIGS. 2, 3 and 4.

As seen in FIG. 5, since the structural module 10 is provided with pillars 20, the porous block 15 is provided with appropriate apertures 15*a* and/or cut outs 15*b* to receive the pillars 20. Such a configuration is advantageous in that the porous block 15 is constrained from substantial lateral movement by virtue of engagement of the pillars 20 in the apertures 15*a*, and is also constrained from vertical movement because the size of the apertures 15*a* is chosen so that there will be a reasonably tight fit with the pillars 20, thus locating the block firmly in the desired position in the structural module 10.

In preferred embodiments of the invention, the structural module has rigid top and bottom walls and rigid supporting elements, such as pillars or a sidewall, so that it can resist collapse under the loads to be encountered, which could for example include the weight of humans, animals, vehicles or equestrian fences positioned or passing over the structural module. A preferred structural module has a short term vertical compressive strength of at least about 500 kN/m$^2$, more preferably at least about 650 kN/m2, and more preferably at least about 700 kN/m$^2$. The short term vertical deflection is preferably less than about 2 mm/126 kN/m$^2$, and more preferably less than about 1.5 mm/126 kN/m$^2$, in a preferred arrangement being about 1 mm/126 kN/m$^2$. A preferred structural module is manufactured in a strong, rigid plastics material such as polypropylene copolymer.

Preferably, the percentage of the volume of the structural module that is void space, ignoring the presence of a foam insert or the like, is at least about 80%, at least about 85%, or at least about 90%. In a preferred embodiment the void space is about 95%. For a structural module with top and bottom walls and a side wall enclosing a volume within the structural module, the percentage of surface area that is apertured is at least about 40%, at least about 45%, or at least about 50%. In a preferred embodiment the percentage of surface area that is apertured is about 52%.

One suitable structural module has the following parameters:

Weight 3.00 kg
Dimensions:
Length 708 mm
Width 354 mm
Height 150 mm
Short Term Compressive Strength:
Vertical 715 kN/m$^2$
Lateral 156 kN/m$^2$
Short Term Deflection:
Vertical 1 mm per 126 k kN/m$^2$
Lateral 1 mm per 15 kN/m$^2$
Ultimate tensile strength of a single joint 42.4 kN/m$^2$
Tensile strength of a single joint at 1% secant modulus 18.8 kN/m$^2$
Bending resistance of module 0.71 kNm
Bending resistance of single joint 0.16 kNm
Volumetric void ratio 95%
Average effective perforated surface area 52%

In preferred arrangements, structural modules can be connected together to form a layer by ties, such as tie members 22 discussed earlier. Structural modules may be connected vertically by tubular shear connectors which can fit into the open ends of the support pillars in the arrangement described earlier.

Figure 7:
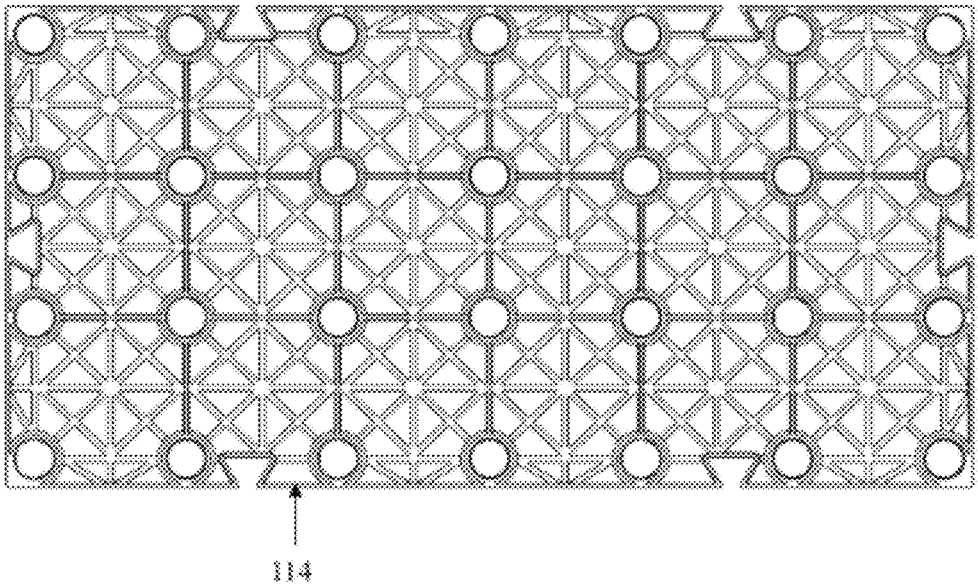
FIG. 7 is a plan view of a preferred structural module for use in aspects of the invention.
Figure 8:
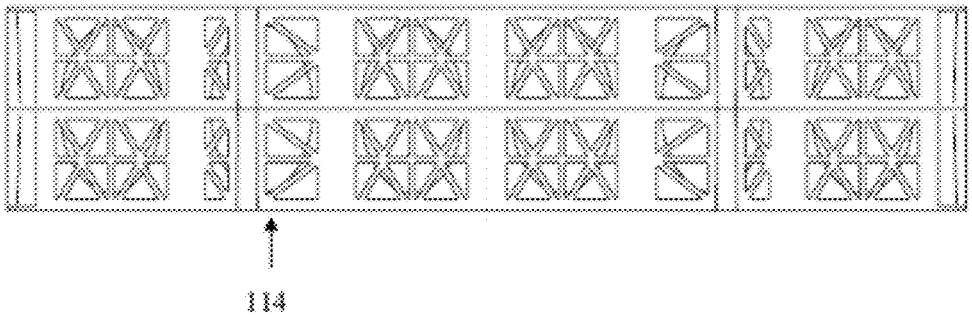
FIG. 8 is a front elevation of the structural module.
Figure 9:
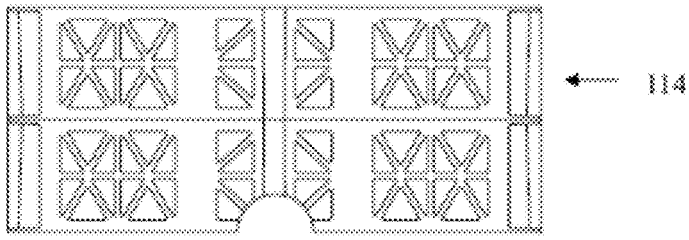
FIG. 9 is a side elevation of the structural module.
Figure 10:
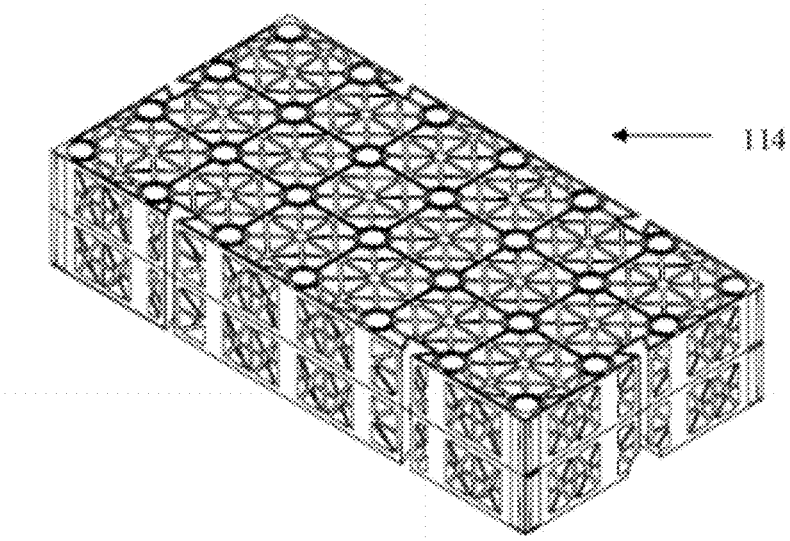
FIG. 10 is a perspective view of the structural module.

FIG. 7 is a plan view of a cuboid structural module 114 for use in aspects of the invention, having the parameters set out above. FIG. 8 is a front elevation of the structural module, FIG. 9 is a side elevation of the structural module, and FIG. 10 is a perspective view of the structural module. As with the structural module 10 described with reference to FIGS. 1 to 6, this structural module 114 has been moulded in two halves which are then joined together.

Figure 11:
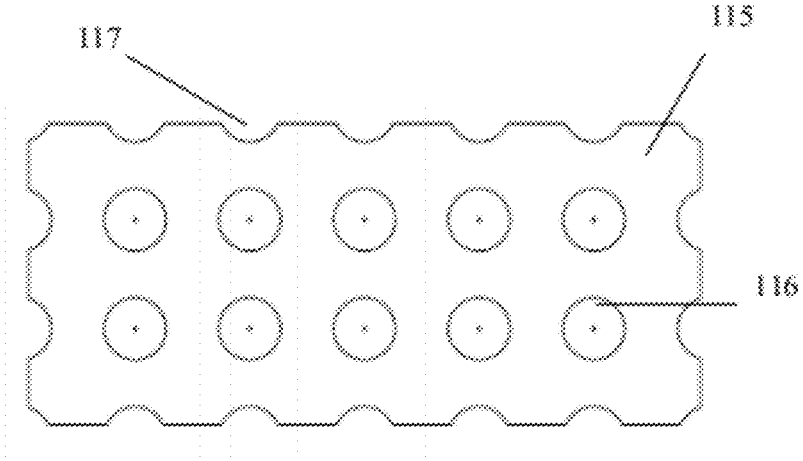
FIG. 11 is a plan view of a porous foam insert to be positioned in the structural module.

FIG. 11 is a plan view of a porous, water retentive, foamed polymeric insert 115 of OASIS™ foam to be used within the structural module 114, this having a thickness of about 75 mm so that it will occupy about one half only of the internal volume of the structural module. The interior of the structural module is provided with columns and the insert has apertures 116 and cut-outs 117 to accommodate these.

Figure 12:
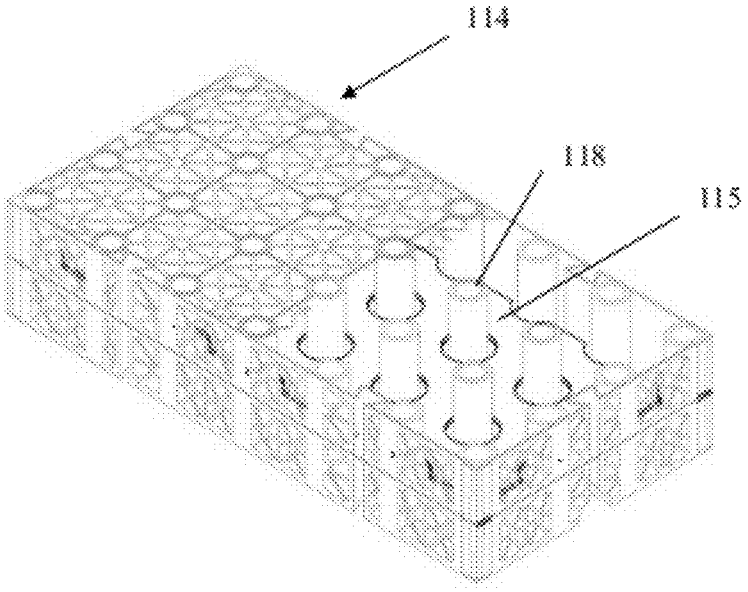
FIG. 12 is a perspective view of the structural module, partly cut away, showing the insert in place.

FIG. 12 shows the structural module 114 partly cut away, showing how the insert 115 has been positioned in the lower half of the structural module 114, with the apertures 116 and cut-outs 117 accommodating the supporting columns 118 within the structural module 114, in a manner equivalent to that discussed with reference to the structural module 10 of FIGS. 1 to 6.

Figure 13:
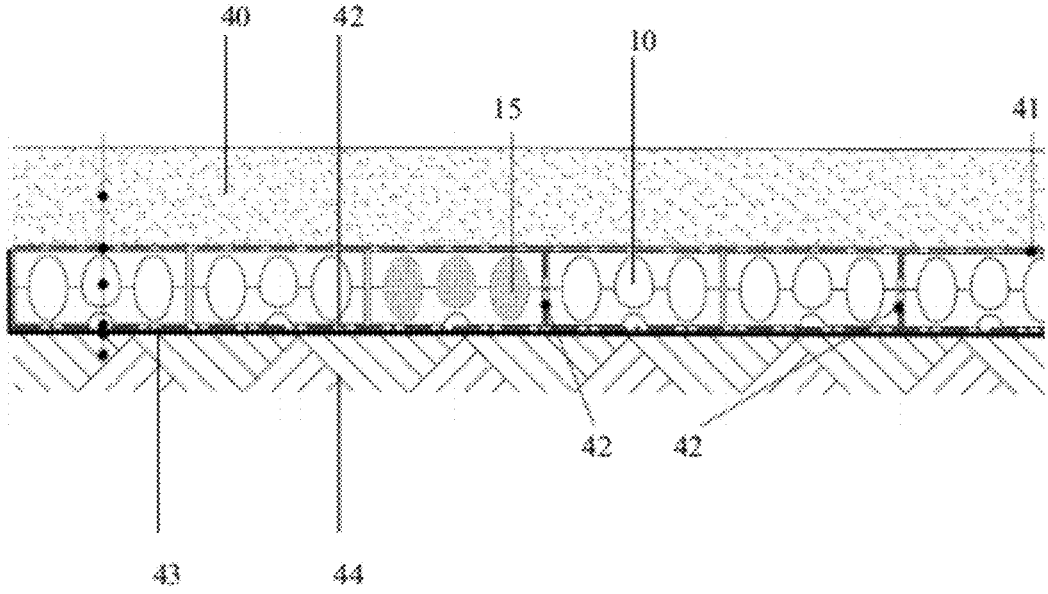
FIG. 13 is a section of a preferred embodiment of an equestrian area according to the invention.

Referring to FIG. 13, in a preferred embodiment of the equestrian area of the present invention, a plurality of structural modules 10 are arranged to form a continuous layer. The number of structural modules 10 is chosen in order to provide sufficient coverage over the desired area. One or more of the structural modules 10 contains a porous block 15. Not all of the structural modules 10 need necessarily contain a porous block 15, although in some embodiments all of the structural modules 10 may contain a porous block 15. The number and distribution (spatial frequency) of the structural modules 10 and the porous blocks 15 within the structural modules 10 is determined by factors such as average rainfall, average humidity, average temperature and wind speed of the environment in which the surface is to be used. It is also determined by the water capacity of the porous blocks 15 being used as well as the ideal moisture content of the surface for its intended use.

Beneath the layer of structural modules 10 is provided wicking means 42. The wicking means 42 also extends up around the sides of at least some of the structural modules 10 in vertical portions. The wicking means 42 is a geotextile capillary blanket formed of hydrophilic fibres. The amount and distribution of the wicking means 42 provided is determined such that a prescribed water content can be maintained in the upper surface layer 40 at most, if not all, times.

Beneath the wicking means 42 is provided a sealing layer 43. The sealing layer is a waterproof membrane which prevents water from leaking out of the surface. The sealing layer 42 is made of a continuous sheet of flexible plastic material that is puncture resistant and strong enough to avoid damage during installation and use of the surface. All joints in the sealing layer 42 are twin wedge welded to ensure complete water containment.

Beneath the sealing layer 43 is a foundation 44. The foundation 44 is not part of the surface itself but is should be prepared to form a relatively smooth and level surface before the surface is installed on the foundation 44.

A water permeable layer 41 is provided above the layer of structural modules 10. The water permeable layer 41 is a non-biodegradable geotextile fleece layer. Alternatively, the water permeable layer 41 may be made of the same material as the wicking means 42. The water permeable layer 41 is around 4 mm thick and can cushion and dissipate the impact of forces exerted on the surface. In addition, the water permeable layer 41 prevents fine materials from the upper surface layer 40, which is located above the protective layer 10, from descending into the structural modules 10, whilst being water permeable such that it still allows water from the upper surface layer 40 to descend into the structural modules 10, and water to pass up from the layer below.

The upper surface layer 40 is formed of a material suitable for the intended use of the surface. For example, in some cases it will be formed of soil covered with turf. In other cases, an artificial surface will be used. The artificial surface can contain a blend of components tailored for the surface's specific intended use. For certain equestrian uses, the upper surface layer 40 may be formed of sand with a certain percentage of additives such as fibres or geotextiles, for example. In some cases the upper surface layer 40 or components thereof may have a wax coating to improve grip and drainage. The upper surface layer 40 may have a depth of around 150 mm.

In use, water, such as rain water, is stored in the porous blocks 15 in the structural modules 10. The wicking means 42 transports the water by capillary action from the porous blocks 15 in the structural modules 10 up to the water permeable layer 41, from which it is absorbed by the upper surface layer 40 in order to regulate the water content of the upper surface layer 40.

Figure 14:
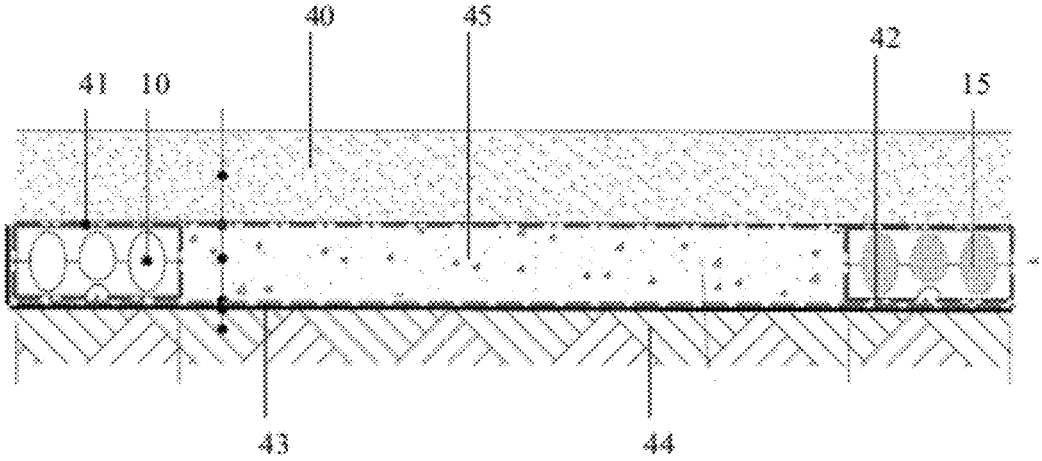
FIG. 14 is a section of an alternative embodiment of an equestrian area according to the invention.

Referring to FIG. 14, this shows an alternative embodiment of the equestrian surface of the present invention. In contrast with the embodiment shown in FIG. 13, in FIG. 14 the structural modules 10 are spaced apart from one another rather than forming a continuous layer. Between the structural modules 10 is provided a layer of aggregate 45. In the embodiment shown in FIG. 14, the distance between the structural modules is around 6 m. As with the porous blocks 15, the number and distribution (spatial frequency) of the structural modules 10 is determined by factors such as average rainfall, average humidity, average temperature and wind speed. Cost may also be a factor in some cases.

In FIG. 14, each structural module 10 is encapsulated by wicking means 42.

In FIGS. 13 and 14 each structural module 10 has a length of 354 mm.

In either of the embodiments shown in FIGS. 13 and 14, a further impact protection layer, such as rubber matting with holes therein, can be provided above the structural modules 10 (and above the aggregate layer 45, if necessary).

Figure 15:
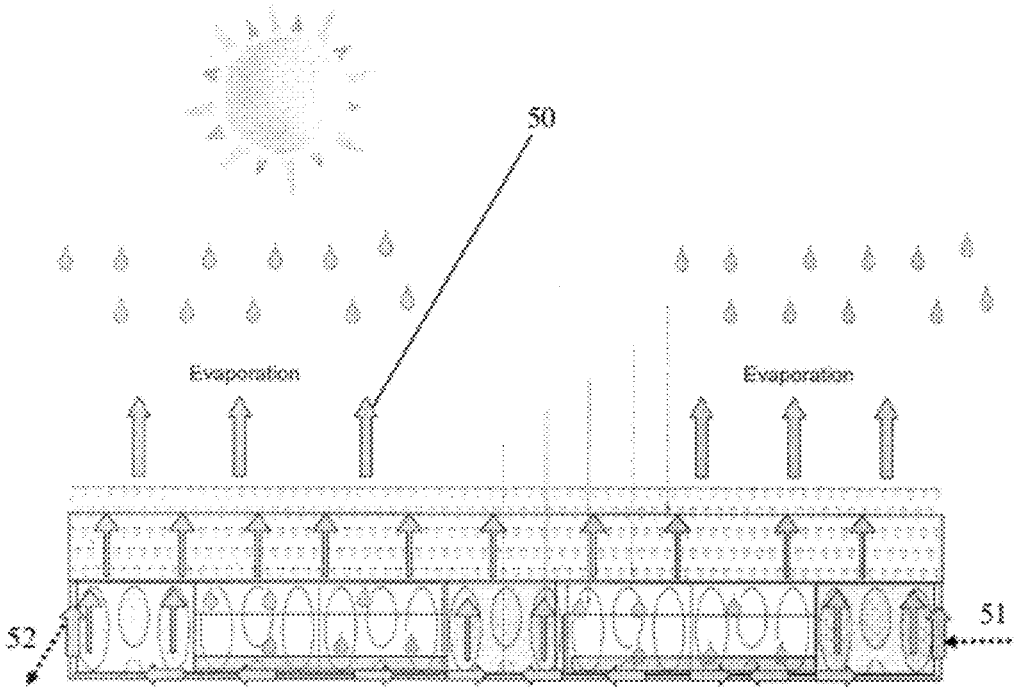
FIG. 15 illustrates water flow through an alternative embodiment of an equestrian area according to the invention.

FIG. 15 shows how water flows through a preferred embodiment of the equestrian surface. The arrows 50 indicate water flow. Rain water falls on the upper surface layer 40 and descends into the structural modules 10 where, in some structural modules 10, it is stored in the porous blocks 15. The upper surface layer 40 and the water permeable layer 41 allow water to descend quickly into the structural modules 10 to prevent the upper surface layer 40 from becoming too wet or waterlogged.

The porous blocks 15 hold water and release it slowly over time. The water passes from the porous blocks 15 into the wicking means 42, which transport the water up to the water permeable layer 41, from which it is absorbed by the upper surface layer 40.

If the air conditions are dry and warm enough, water from the upper surface layer 40 can evaporate into the air.

If so much rain falls that the porous blocks 15 cannot contain any more water (e.g. during a storm), excess water can be drained off, as indicated by arrow 52, via an overflow pipe (not shown) to a storage tank (not shown). Alternatively, or in addition, the water level in the structural modules 10 and/or porous blocks 15 can be topped up during dry periods from a water supply (which could be the storage tank for excess water) by a gravity feed or a pump, as indicated by the arrow 51.

The equestrian surface is self-regulating and the flow rate is determined by the density, distribution and specific properties of the wicking means 42, as well as the density, distribution and specific properties of the structural modules 10 and porous blocks 15. As the water content of the upper surface layer 40 changes (through rainfall and/or evaporation), water passes in and out of the porous blocks 15 via an osmosis/diffusion process to regulate the water content of the upper surface layer 40. As such, the equestrian surface can be used in most, if not all, weather conditions

The invention claimed is:

1. An equestrian area on which horses move, comprising an upper, equestrian surface layer, and a sub-surface support layer which includes a plurality of laterally arranged load bearing structural modules, each of which comprises a top wall and a bottom wall spaced therefrom by one or more supporting elements so as to define an interior volume between the top and bottom walls, and each module being provided with at least one open aperture to permit the flow of water into and out of the volume, and there being a system for retaining water within at least some modules in the sub-surface support layer, wherein a water permeable layer that is impermeable to solid particles of the upper, equestrian surface layer is provided between the structural modules and the equestrian surface layer, and wherein a wicking system is in fluid communication with the interior volumes of at least some of the modules and has portions extending upwardly to transfer water to the upper, equestrian surface layer from the sub-surface support layer.

2. An equestrian area as claimed in claim 1, wherein at least one aperture is provided in the bottom wall.

3. An equestrian area as claimed in claim 1, wherein at least one open aperture is provided in one or more of the at least one supporting elements.

4. An equestrian area as claimed in claim 1, wherein the system for retaining water comprises a waterproof layer beneath the modules.

5. An equestrian area as claimed in claim 4, wherein the waterproof layer beneath the modules is arranged to distribute water laterally in the sub-surface support layer.

6. An equestrian area as claimed in claim 1, wherein the system for retaining water comprises a water absorbent material contained within at least one of the modules.

7. An equestrian area as claimed in claim 6, wherein the water absorbent material is a block of foamed polymeric material.

8. An equestrian area as claimed in claim 6, wherein the water absorbent material occupies a substantial portion of the volume within the structural module and can absorb and retain substantial quantities of water that pass into the interior volume.

9. An equestrian area as claimed in claim 6 including at least one module which does not contain water absorbent material.

10. An equestrian area as claimed in claim 1, wherein the wicking system is a layer of wicking material provided beneath the structural modules and upwardly projecting portions of wicking material.

11. An equestrian area as claimed in claim 1, wherein the wicking system comprises hydrophilic fibres.

12. An equestrian area as claimed in claim 1, wherein at least two structural modules are adjacent each other.

13. An equestrian area as claimed in claim 1, wherein there are at least two structural modules which are spaced from each other laterally and which are separated by a filler material.

14. An equestrian area as claimed in claim 1, wherein each structural module has a peripheral wall extending between the top and bottom walls, and acting as a supporting element.

15. An equestrian area as claimed in claim 14, wherein the top, bottom and peripheral walls are provided with the apertures to permit liquid flow to and from the interior volume.

16. An equestrian area as claimed in claim 1, wherein there is further provided a protective layer located above the structural modules.

17. An equestrian area as claimed in claim 1, wherein the water permeable layer comprises hydrophilic fibres.

18. An equestrian area as claimed in claim 1, further comprising a water storage tank in fluid communication with the sub-surface support layer, for receiving water from and supplying water to the sub-surface support layer.

19. An equestrian area as claimed in claim 1, further comprising a heating system for heating the area.

20. An equestrian area as claimed in claim 19, further comprising a temperature sensor.

21. An equestrian area on which horses move, comprising an upper, equestrian surface layer, and a sub-surface support layer which includes a load bearing structural module, which comprises a top wall and a bottom wall spaced therefrom by one or more supporting elements so as to define an interior volume between the top and bottom walls, the module being provided with at least one open aperture to permit the flow of water into and out of the volume, wherein the structural module contains a foamed polymeric material which occupies a substantial portion of the volume within the structural module and can absorb and retain substantial quantities of water that pass into the enclosed volume through the at least one aperture, wherein a water permeable layer that is impermeable to solid particles of the upper, equestrian surface layer is provided between the structural module and the upper, equestrian surface layer, and wherein a wicking system is in fluid communication with the interior volume and has a portion extending upwardly to transfer water to the upper, equestrian surface layer from the sub-surface support layer.

22. A method of controlling the moisture content of an equestrian area on which horses move, the equestrian area comprising an upper, equestrian surface layer, and a subsurface support layer which includes a plurality of laterally arranged load bearing structural modules, each of which comprises a top wall and a bottom wall spaced therefrom by one or more supporting elements so as to define an interior volume between the top and bottom walls, and each module being provided with at least one open aperture to permit the flow of water into and out of the volume, and there being a water retaining system for retaining water within at least some modules in the sub-surface support layer; wherein a water permeable layer that is impermeable to solid particles of the upper, equestrian surface layer is provided between the structural modules and the equestrian surface layer; and wherein a wicking system is in fluid communication with the interior volumes of at least some of the modules and has portions extending upwardly to the equestrian surface layer;

wherein in said method, water that has been applied to the equestrian surface layer passes through the water permeable layer to the sub-surface support layer, at least some of the water is retained within modules in the sub-surface support layer by the water retaining system, and subsequently water that has been retained by the water retaining system is transferred by the wicking system from the sub-surface support layer to the equestrian surface layer.

23. A method as claimed in claim 22, wherein the water retaining system in the modules includes water absorbent material contained within at least some of the modules.

24. A method as claimed in claim 23, in which the water absorbent material is foamed polymeric material.

25. A method as claimed in claim 22, wherein an external supply of water is connected to the modules in the sub-surface support layer and supplies water to the modules to top up the water retained by the water retaining system in the modules.

* * * * *